US009181715B2

(12) United States Patent
Orchard

(10) Patent No.: US 9,181,715 B2
(45) Date of Patent: Nov. 10, 2015

(54) CLIP DEVICE FOR ATTACHING STRUCTURAL MEMBER TO A SUPPORTING STRUCTURE

(71) Applicant: Brian Keith Orchard, Dorchester (CA)

(72) Inventor: Brian Keith Orchard, Dorchester (CA)

( * ) Notice: Subject to any disclaimer, the term of this patent is extended or adjusted under 35 U.S.C. 154(b) by 0 days.

(21) Appl. No.: 13/656,911

(22) Filed: Oct. 22, 2012

(65) Prior Publication Data

US 2013/0104493 A1 May 2, 2013

Related U.S. Application Data

(60) Provisional application No. 61/552,101, filed on Oct. 27, 2011.

(51) Int. Cl.
*E04B 1/38* (2006.01)
*E04C 5/00* (2006.01)
*E04F 15/02* (2006.01)

(52) U.S. Cl.
CPC . *E04F 15/02044* (2013.01); *E04F 2015/02122* (2013.01)

(58) Field of Classification Search
CPC ..... E04F 15/02044; E04F 15/04; E04F 2015/02122; E04F 2201/05; E04F 2201/0115; E04F 2201/023; E01C 5/22
USPC ..... 52/586.1, 586.2, 585.1, 650.3
See application file for complete search history.

(56) References Cited

U.S. PATENT DOCUMENTS

| | | | | |
|---|---|---|---|---|
| 1,714,738 | A * | 5/1929 | Smith | 52/512 |
| 6,402,415 | B1 | 6/2002 | Eberle, III | |
| 6,651,398 | B2 | 11/2003 | Gregori | |
| 6,711,864 | B2 | 3/2004 | Erwin | |
| 6,810,633 | B2 | 11/2004 | Harris, Sr. | |
| 6,851,884 | B2 | 2/2005 | Eberle | |
| 7,052,200 | B2 | 5/2006 | Harris | |
| 7,409,803 | B2 * | 8/2008 | Grohman | 52/489.1 |
| 7,546,717 | B2 * | 6/2009 | Juan Puerta | 52/586.1 |
| 7,578,105 | B2 | 8/2009 | Eberle, III | |
| 7,600,353 | B2 * | 10/2009 | Hafner | 52/582.1 |
| 7,874,113 | B2 | 1/2011 | Eberle, III | |
| 7,908,812 | B2 | 3/2011 | Eberle, III | |
| 7,984,599 | B2 | 7/2011 | Snell et al. | |
| 8,011,153 | B2 | 9/2011 | Orchard | |
| 8,161,702 | B2 | 4/2012 | Eberle, III | |
| 2007/0028550 | A1 * | 2/2007 | Clapper | 52/650.3 |
| 2008/0311355 | A1 * | 12/2008 | Chen et al. | 428/195.1 |
| 2009/0249730 | A1 * | 10/2009 | Vibiano | 52/586.2 |

* cited by examiner

*Primary Examiner* — Brian Mattei

(57) ABSTRACT

A Π-shaped clip with a top horizontal portion and a pair of integrally formed spaced apart vertical legs underneath. The legs define a spacing distance across their span and are inwardly compressible toward each other in response to a side force. The top portion has raised gripping means for frictional engagement. The clip is inserted into grooves of adjacent structural members secure them to a supporting structure.

3 Claims, 3 Drawing Sheets

CLIP DEVICE FOR ATTACHING STRUCTURAL MEMBER TO A SUPPORTING STRUCTURE

FIELD OF THE INVENTION

The invention relates to an under deck fastening clip, system and method which can be used to "invisibly" attach a structural member to a supporting joist-like structure.

BACKGROUND OF THE INVENTION

There are a variety of decking systems on the market today. Most of the decking systems utilize some sort of fastening means to attach the structural members to the underlying joists such as a screw, nail or staple. Typically, the fastening means is installed directly through the top face of the structural members to the joist below.

The common method of securing the structural members to the underlying joists by directly fastening the structural member to the joist through the top face of the structural member has many drawbacks. First, the fasteners are visible, unattractive and take away from the façade or look of the natural wood. The fasteners may rust and discolor the structural members. A fastener may work loose and become a safety hazard to persons walking on top of the supporting structure. Finally, hammer blows to decking surface during installation of the fastener may cause damage and/or depressions that collect water. The collection of water may lead to splintering of the structural members, mold growth and the propagation of cracks starting at where the fastener installation occurs.

Another problem associated with the above is the potential for error during installation of the structural members because the installer cannot see exactly where the joists lie underneath the structural member. Resultantly, during installation of fasteners the installer may miss a joist or only partially strike a joist with the fastener and may have to back out the fastener or leave the fastener in the structural member and install yet another fastener to secure the structural member to the joist.

Another shortcoming is the potential for the structural members to loosen and move over time losing its uniform look resulting in loss of aesthetic appeal. In addition, the structural members may move to close the gaps between the installed structural members. The gaps between structural members are necessary to provide a means for rainwater or other liquids to drain from the supporting structure and for ventilation.

As a consequence of the foregoing, different types of fastening clip devices have been proposed to secure the structural members to the supporting structure invisibility without disturbing the appearance of the deck surface. According to the present invention an improved clip device is proposed which is easy to manufacture and simple to use. Additionally the clip device prevents lateral movement of structural members relative to one another and is designed to accommodate expansion and contraction forces to which the structural members are subjected by nature.

SUMMARY OF THE INVENTION

One object of the invention is to provide a system wherein the structural members are easy to install and wherein the structural members can be installed and maintained without access to the underside of the structural members.

Another object of the present invention is to provide a system wherein the structural members can be installed without the penetration of the top surface of the structural member with a fastener.

Another object of the present invention is to provide a decking installation system, method and clip with a cost effective means of manufacture and installation.

Another object of the present invention is to eliminate the need to use spacers during installation while maintaining the required consistent spacing among the structural members during installation.

Another object of the invention is to provide a clip which facilitates and accommodates the lateral expansion of the structural members and prevent their longitudinal movement with reference to the clip.

According to yet another object of the invention, the clip according to this invention is generally a Π-shaped clip device having a top horizontal portion and a pair of integrally formed spaced apart vertical legs underneath. The legs define a spacing distance across their span and are inwardly compressible toward each other in response to a side force. The top or bottom surface of the top portion has raised gripping means for frictionally engagement. The side edges of the horizontal portion are inserted into the grooves of adjacent structural members to abut against said legs to thereby engage and secure the structural members to a supporting structure separated from each other by the spacing distance.

Further features of the invention will be described or will become apparent in the course of the following detailed description.

BRIEF DESCRIPTION OF THE DRAWINGS

In order that the invention may be more clearly understood, embodiments thereof will now be described in detail by way of example, with reference to the accompanying drawings, in which.

DESCRIPTION OF PREFERRED EMBODIMENTS

Figure 1:
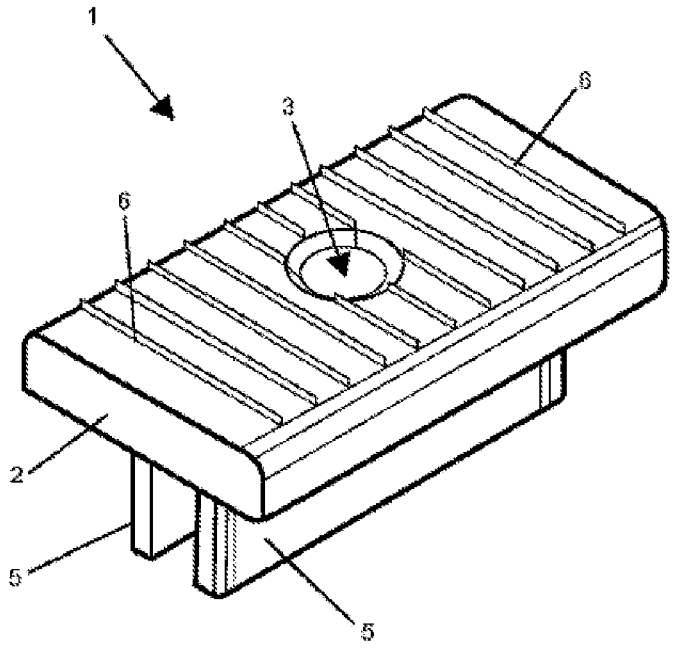
FIG. 1 is an isometric view of a clip device according to the present invention.

Referring to FIG. 1, a generally Π-shaped clip device 1 according to the present invention is illustrated. The clip is intended to be used in conjunction with structural members 8 or planks which are manufactured with longitudinal grooves or slots 9 on each opposing side edge as shown in FIG. 5. As will be described hereafter, the clip device 1 is securely fastened to the surface of a supporting surface such as an underlying joist 10 and serves as an anchoring device to secure adjacent structural members 8 in place.

Figure 3:
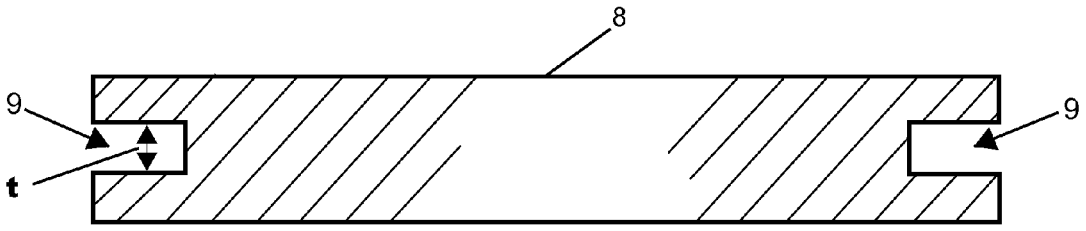
FIG. 3 is a side view of a structural member according to the present invention.

Referring to FIG. 3, grooves 9 are provided in the opposing side edges of the structural members 8. The groove has a thickness t and divides the side edge into a top and bottom edge portion. The groove functions to receive the clip during installation of the decking system. The structural members 8 may be manufactured from a non-wood material such as PVC or composite materials, or alternatively, traditional wood structural members modified with grooves may also be used.

Referring to FIGS. 1-4, the clip device 1 may be made from any material that is suitable. In the preferred embodiment the clip device 1 is manufactured from a durable plastic material. The clip device 1 comprises a top horizontal portion 2 that is provided with a centrally located fastener receiving hole 3. In the preferred embodiment the top portion 2 of the clip is rectangular in shape having side edges for insertion and retention in the groove of the structural member. In alternative embodiments of the present invention, the top portion 2 may be of any other shape that is suitable such as a circle, oval or biscuit. In the preferred embodiment the fastener receiving hole 3 is located in the center of the top portion 2 overlying the space between the legs 5. In the preferred embodiment the thickness of the top portion 2 corresponds to the width of the groove 9 of the structural member 8 to enable the insertion and retention of the side edges of the top portion 2 in the groove 9 by way of a friction fit against the top or bottom inner surfaces of the groove as will be hereafter described.

Figure 2:
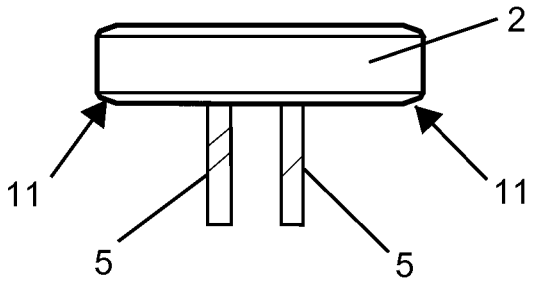
FIG. 2 is a side view of a clip device according to the present invention.
Figure 4:
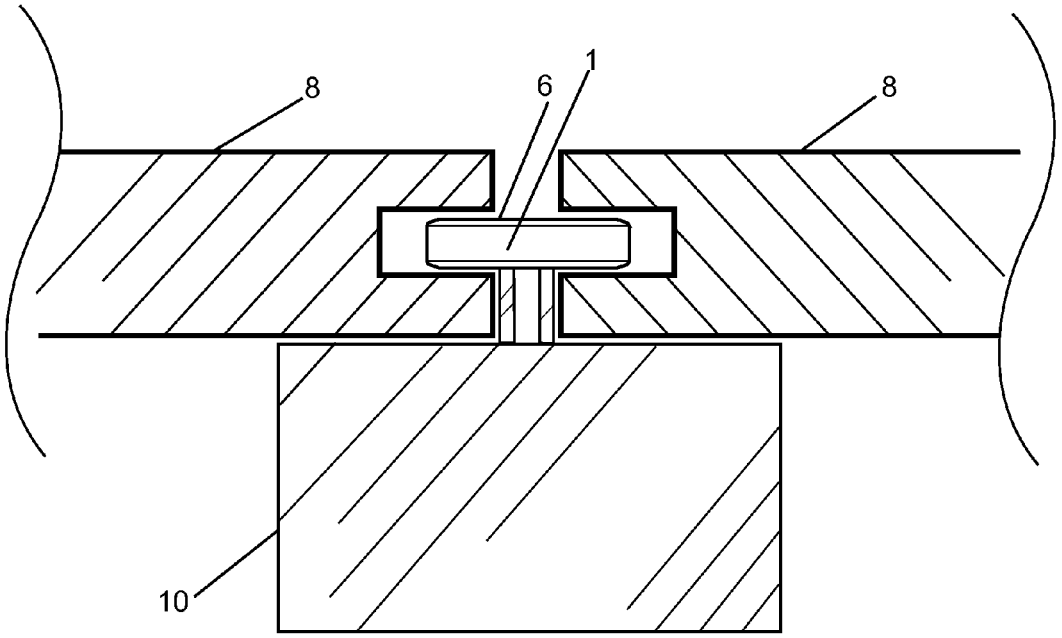
FIG. 4 is a side schematic view of a decking system according to the present invention.

As shown in FIGS. 1 and 2, two spaced apart vertical leg members 5 project downwardly from the underside of the top portion 2 on each side of the fastener receiving hole 3. As can be seen in FIG. 2 the legs 5 are located inwardly from the outer periphery of the clip device 1 to define opposed side edges 11 for insertion into the grooves of adjacent structural members. The vertical leg members 5 have a length equal to the height of the bottom edge portion of the structural member. When one side edge of the top portion of the clip device is inserted into the groove of a structural member, the outer surface of one leg will abut the bottom edge of the structural member as shown in FIG. 4. Similarly, insertion of the opposite side edge into the groove of an adjacent structural member will result in the other leg coming into contact with the bottom edge of the structural member. In this way the horizontal distance or span between the legs provides uniform spacing between the structural members when installed. In the preferred embodiment the vertical leg members 5 extend parallel to each other and are of uniform shape, thickness and length.

Use of the clip device 1 to install a decking system is schematically illustrated in FIG. 4. The system has a plurality of joists 10 (only one is shown), a plurality of structural members 8 (two are shown), a plurality of clip devices 1 (only one is shown). The joists 10 are laid out in a usual regularly spaced apart relationship. The structural members 8 are fastened to the upper surfaces of the joints in a spaced apart side-by-side manner running perpendicular to the joists 10 using the clip devices. Each clip is fastened to the joist by means of a fastening device such as a fastener screw (not shown) passing through the receiving hole 3 which overlies the space between the legs 5.

Referring to FIG. 4, a first structural member 8 is installed to the underlying joist 10 by inserting one side edge 11 into the groove and fastening the clip device 1 to the joist 10 with a fastener 12. To install an adjacent structural member 8 the opposite side edge 11 of the clip device 1 is inserted into the groove of the adjacent structural member 8. In each case the clip device 1 is fitted so that each of the vertical legs 5 respectively abuts the bottom edges of the adjacent structural member 8 as shown. The clip device 1 is held in place in the groove by way of a friction fit. Numerous clip devices 1 are thereby similarly inserted and attached at spacing corresponding to the spacing of the underlying joists 10.

After installation the structural members 8 may expand and contract widthwise as a result of moisture, humidity and weather thereby exerting a side force on the legs 5. The spaced apart leg members 5 are compressible inwardly toward each other to accommodate the widthwise expansion of the boards. As the structural members 8 expand, the legs 5 compress inwardly towards each other thereby accommodating the expansion. As the structural members 8 contract, the legs 5 spring back to their original position.

After installation the structural members 8 may have forces applied along their lengthwise axis. In order to counteract the forces and to resist and prevent lengthwise movement of the structural members 8 with reference to the clip device 1 and each other, the top and/or bottom surface of the top portion 2 of the clip device 1 may be provided with gripping elements 6 to frictionally engage the inner surface of the groove. As shown in FIG. 1 the gripping elements 6 may be comprised of raised parallel ribs extending widthwise across the top surface of the top portion 2 having a vertical height above the surface of the top portion of the clip. The ribs frictionally engage the inner surface of the groove 9 and act to prevent lateral or lengthwise movement of the structural member 8. In this embodiment, the thickness of the top portion 2 of the clip device 1 including the height of the ribs, must be sized to substantially equal the width of the groove 9 to ensure a friction fit. In alternative embodiments of the present invention the gripping elements 6 may consist of raised protuberances that are suitable to resist the lengthwise movement of the structural members 8 such as, for example, fingers or raised protrusions. The gripping elements 6 may be provided on the bottom surface or the top portion 2 in addition to or instead of the gripping elements 6 provided on the top surface of the top portion 2 to provide additional resistance to movement.

Further advantages which are inherent to the invention are obvious to one skilled in the art. The embodiments are described herein illustratively and are not meant to limit the scope of the invention as claimed. Variations of the foregoing embodiments will be evident to a person of ordinary skill and are intended by the inventor to be encompassed by the following claims.

What is claimed:

1. The combination of a π-shaped clip device and a decking system, wherein said decking system comprises a supporting structure and a plurality of structural members having a rectangular cross section and a longitudinal groove in each side edge defining a top and bottom edge, said top and bottom edges being aligned vertically with one another and said groove having a top and bottom groove inner surface and a groove thickness therebetween, and wherein said π-shaped clip device comprises:

a top horizontal portion having a thickness, a top surface and a bottom surface;

a pair of integrally formed spaced apart vertical legs extending downwardly from the bottom surface, each leg spaced inwardly from the sides of the top horizontal portion;

said legs defining a spacing distance across their span and having a length equal to at least the thickness of the bottom edge, wherein each of said legs abuts the bottom edge of the adjacent structural member thereby providing uniform spacing between said top and bottom edges of said structural members, and said legs being inwardly compressible toward each other in response to a force;

said top or bottom surface having a plurality of raised protuberances formed integrally within the periphery of the top or bottom surface for frictionally engaging the top or bottom groove inner surface wherein the thickness of the top portion and the height of said protuberances are at least equal to the groove thickness; and fastener receiving means in the top portion overlying the space between the legs for receiving a fastener therethrough to attach the π-shaped clip device to the supporting structure;

wherein the side edges of the horizontal portion are inserted into the grooves of adjacent structural members to abut against said legs to thereby engage and secure the structural members to the supporting structure separated from each other at both said top and bottom edges by the spacing distance.

2. The invention as claimed in claim 1 wherein said fastening means is a hold adapted to receive a fastener for fastening the π-shaped clip device to a joist member.

3. The invention as claimed in claim 1 wherein said protuberances are ribs.

* * * * *